United States Patent [19]

Garcia

[11] Patent Number: 4,881,739

[45] Date of Patent: Nov. 21, 1989

[54] GOLF PUTTER

[76] Inventor: Larry Garcia, 160 Ashley La., Oldsmar, Fla. 34677

[21] Appl. No.: 121,749

[22] Filed: Nov. 16, 1987

[51] Int. Cl.[4] ..... A63B 53/04

[52] U.S. Cl. ..... 273/164; 273/175; 273/167 B; 273/167 C

[58] Field of Search ..... 273/167 C, 167 B, 175, 273/164, 167 R, 167 D, 167 J; D21/217, 218, 219

[56] References Cited

U.S. PATENT DOCUMENTS

| | | | |
|---|---|---|---|
| D. 138,380 | 7/1944 | Myers et al. | D21/217 |
| 1,525,137 | 2/1925 | Lawton | 273/167 C |
| 2,665,909 | 1/1954 | Wilson | 273/168 |
| 3,394,937 | 7/1968 | Allport | 273/167 B |

FOREIGN PATENT DOCUMENTS

| | | | |
|---|---|---|---|
| 14169 | of 1898 | United Kingdom | 273/175 |
| 27807 | of 1911 | United Kingdom | 273/167 B |

OTHER PUBLICATIONS

"Popular Mechanics", vol. 128, No. 3, Sep. 1967, p. 83.

*Primary Examiner*—George J. Marlo
*Attorney, Agent, or Firm*—Dominik, Stein, Saccocio, Reese, Colitz & Van Der Wall

[57] ABSTRACT

A putter head comprising a top portion formed with a hosel for coupling the head to a shaft; a bottom portion formed with a sole for positioning the putter head in a ball-striking orientation on a putting green; and a ball-striking face located therebetween. The ball-striking face is arcuate in cross-sectional shape curved about an axis located in a horizontal plane between the top portion and the bottom portion. The radius of curvature of the ball-striking face is essentially 0.84 inches. Both the horizontal plane and the axis of the ball-striking face are located essentially 0.84 inches from the sole. The curved face extends downwardly from at least the horizontal plane.

1 Claim, 1 Drawing Sheet

GOLF PUTTER

BACKGROUND OF THE INVENTION

1. Field of the Invention

This invention relates to a putter and, more particularly, to a golf putter with an improved putter face.

2. Description of the Background Art

The game of golf consists of several elements that include, among others, the art of putting. In order to score well, a golfer must place the golf ball into the golf hole in the least possible number of strokes. On a par five hole, the "Par" standard allows for one tee shot, two fairway shots, and two putts to complete the golf hole. A par four hole allows for one tee shot, one fairway shot, and two putts. A par three hole allows for one tee shot and two putts. On a typical golf course there are four par five holes, ten par four holes, and four par three holes. With a little calculation it can be established that an equal emphasis is placed on putting as is placed on all others shots. the "Par" standard calls for 36 putts and 36 of all other golf shots.

It is desirable to drive a tee shot as straight and long as possible and to hit the approach shot to the green as close to the golf hole as possible. The fact still remains that not matter how close you have managed to get to the golf hole with your approach shot, you will have to putt the golf ball into the golf hole in the least number of strokes. To this end, the golf putter herein described has been invented.

The commonly accepted design of a golf putter face is either a flat face, which would tend to drive the golf ball level to the putting surface toward the golf hole; or a slightly lofted face, that would elevate the golf ball from the putting surface for a short distance in order to establish direction toward the golf hole and upon its impact with the putting face would establish spin to the golf hole. An obvious drawback to these designs is that they create "skid" or "slide," which is the initial travel of the golf ball prior to the moment when the friction from the putting surface forces the golf ball to begin its forward roll toward the golf hole. Since this "skid" or "slide" occurs immediately after impact between the golf putter face and the golf ball, it does not allow the energy expended by the golfer to be utilized to its fullest, or most efficiently as would be the case if overspin were immediately imparted on the golf ball by the golf putter face.

Various approaches to putter design are disclosed in the literature. Note for example, U.S. Pat. No. 1,525,137 to Lawton which describes a putter with a curved face wherein "the contact point 8 between the club and the ball is above the center of the ball." The preferred putter would make contact at a point at the center of the ball or above the center of the ball. Lawton further describes a desire to "avoid crowding the ball toward the ground" whereas a preferred putter would propel the golf ball forward with overspin in order to create greater control between the putter face, the golf ball and the putting surface. In addition, Lawton teaches "flexibility of the hosel", whereas a preferred putter would have a rigid hosel to enable greater control of the direction and speed of the golf ball. Finally, Lawton discloses a "convex playing face curving upwardly and backwardly" whereas the face of a preferred putter would only be curved upwardly from the sole.

U.S. Pat No. Des. 138,380 to Myers discloses a golf club head with markings on its hitting face which appear to be for creating back spin in a way very similar to the grooves on currently manufactured golf club faces; however, a preferred putter would have a smooth hitting face intended for creating overspin. The hitting face of the Myers' device is convex, curving both downwardly from the center and backwardly, which means that a person putting may strike the ball either in an upward, direct or downward manner. A preferred putter would be only curved upwardly thereby prohibiting impacting the ball in an upward manner.

Lastly, U.S. Pat. No. 2,665,909 to Wilson describes "no substantial component tending to lift the ball" whereas a preferred putter cannot lift the ball under any circumstances. The Wilson disclosure intends to impart a striking force in "a direction always exactly toward the center of the ball" while the direction of a preferred putter would be such as to impart directional force to the center or only to above the center of the golf ball thereby imparting a forward motion with overspin to the golf ball. In addition, the Wilson disclosure describes that "friction at this point, between the ball and the engaging surface, is insignificant" whereas a preferred putter would cause virtually no friction as a result of the forward impact of the putting face with the golf ball for maximum transfer of force from the golf club to the ball. The preferred putter would impart force not lower than the dead center line of the ball and slightly above the dead center line while the Wilson putter describes "the pressure being applied to the ball along the dead center line". Finally, the Wilson putter describes that "the ball not be lofted to any substantial extent due to the fact that the head 15 is not too much smaller than the ball 25." The preferred putter would eliminate any possibility of moving the ball in an upward motion.

Although many such advances are noteworthy to one extent or another, none achieves the objective of an effective, efficient and economical putter head which always imparts a preferred forward motion with overspin to a golf ball.

As illustrated by the great number of prior patents as well as commercial devices, efforts are continuously being made in an attempt to improve putters to render them more efficient, effective and economical. None of these previous efforts, however, provides the benefits attendant with the present invention. Additionally, prior putters do not suggest the present inventive combination of component elements arranged and configured as disclosed and claimed herein. The present invention achieves its intended purposes, objects and advantages over the prior art devices through a new, useful and unobvious combination of component elements, with the use of a minimum number of functioning parts, at a reasonable cost to manufacture, and by employing only readily available materials.

Therefore, it is an object of this invention to provide an improved putter head comprising a top portion formed with a hosel for coupling the head to a shaft; a bottom portion formed with a sole for positioning the putter head in a ball-striking orientation on a putting green; and a ball-striking face located therebetween, the ball-striking face being arcuate in cross-sectional shape curved about an axis located in a horizontal plane between the top portion and the bottom portion, the radius of curvature of the ball-striking face being about between 0.84 and 1.12 inches and with both the horizontal plane and the axis of the ball-striking face being located essentially 0.84 inches from the sole and with the curved face extending downwardly from at least the horizontal plane.

It is another object of this invention to effectively and repeatedly strike golf balls with a putter with an optimum motion, forward with overspin.

Lastly, it is an object of the present invention to transfer force from a putter to a golf ball in the most efficient manner.

The foregoing has outlined some of the more pertinent objects of the invention. These objects should be construed to be merely illustrative of some of the more prominent features and applications of the intended invention. Many other beneficial results may be attained by applying the disclosed invention in a different manner or modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific preferred embodiment shown in the attached drawings. For the purpose of summarizing the invention, the invention may be incorporated into a putter head comprising a top portion formed with a hosel for coupling the head to a shaft; a lower portion formed with a sole for positioning the putter head in a ball-striking orientation on a putting green; and a ball-striking face located therebetween. The ball-striking face is arcuate in cross-sectional shape curved about an axis located in a horizontal plane between the top portion and the bottom portion. The radius of curvature of the ball-striking face is about between 0.84 and 1.12 inches. Both the horizontal plane and the axis of the ball-striking face are located essentially 0.84 inches from the sole. The curved face extends downwardly from at least the horizontal plane. The preferred part of the ball-striking face for use in striking a ball to be putted is in the horizontal plane. A ball being struck by the preferred part of the ball-striking face will be propelled forwardly with overspin. A ball being struck by other than the preferred part of the ball-striking face will be propelled forwardly with overspin. A ball being struck is precluded from being struck by the putter head above the horizontal plane due to the distance between the horizontal plane and the sole being essentially the same as the radius of curvature of the ball to be struck. The preferred part of the ball-striking face for use in striking a ball is located at the topmost edge of the curved portion of the ball-striking face. The putter head further includes a beveled edge extending upwardly and rearwardly from the ball-striking face and located between the top portion and the horizontal plane.

In addition, for the purposes of summarizing the invention, the invention may also be incorporated into an improved putter head for use with a putter shaft. The improved head comprises a top portion for coupling to a shaft; a bottom portion for resting on a putting green to properly position the head with respect to a ball to be putted; and a face located between the top portion and the bottom portion. The face is formed with a curved shape having its most forwardly projecting point being elevated from the bottom portion by a height substantially equal to the radius of curvature of a golf ball to be struck by the face. The face is formed as a partial cylinder about a substantially horizontal axis. The radius of curvature of the face is substantially equal to the distance between the axis and the bottom portion of the head. The radius of curvature is from about 0.84 and 1.12 inches.

Lastly, for the purpose of summarizing the invention, the invention may be incorporated into a golf putter comprising a shaft and an improved head at the lower end of the shaft. The improved head has a face with a partially circular shape which is curved about an axis. The radius of curvature of the face is essentially equal to, or slightly larger than, the radius of curvature of a golf ball to be struck by the face. The axis of the face is located at a distance from the bottom of the head essentially equal to the radius of curvature of the face. When the putter is in a position for putting a ball with the bottom of the head resting on the putting surface, the axis is located in a plane substantially parallel with the putting surface. When the putter is in a position for putting a ball with the bottom of the head resting on the puttings surface, the plane passes through the center of the ball to be putted. The preferred putting of a ball with forward movement and overspin occurs when the ball is struck by the face with the axis remaining parallel with the putting surface and in a plane containing the axis and the center of the ball or slightly thereabove. The putter face is smooth.

The foregoing has outlined rather broadly some of the more pertinent and important features of the present invention in order that the detailed description of the invention that follows may be better understood so that the present contribution to the art can be more fully appreciated. Additional features of the invention will be described hereinafter which form the subject of the claims or the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar reference characters refer to similar parts throughout the several drawings.

DETAILED DESCRIPTION OF THE INVENTION

Figure 2:
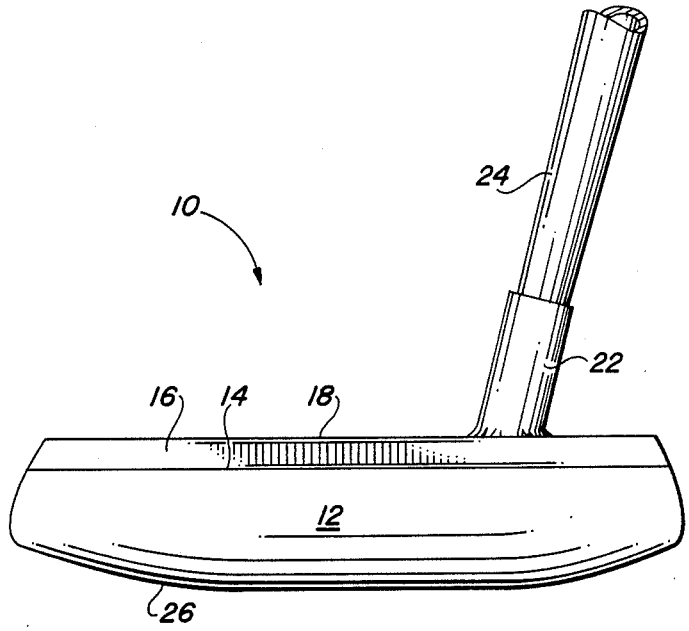
FIG. 2 is a front elevational view of the putter head shown in FIG. 1.
Figure 3:
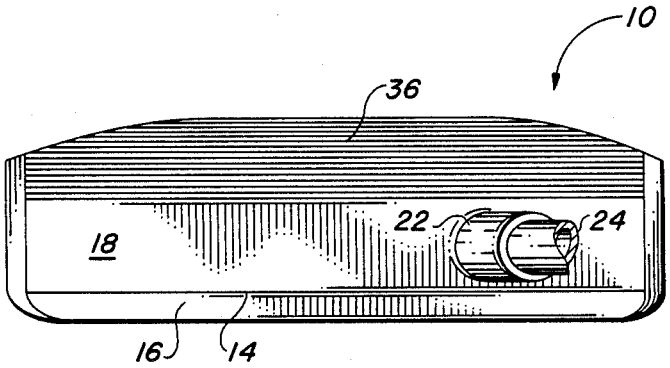
FIG. 3 is a top plan view of the putter head shown in FIGS. 1 and 2.
Figure 1:
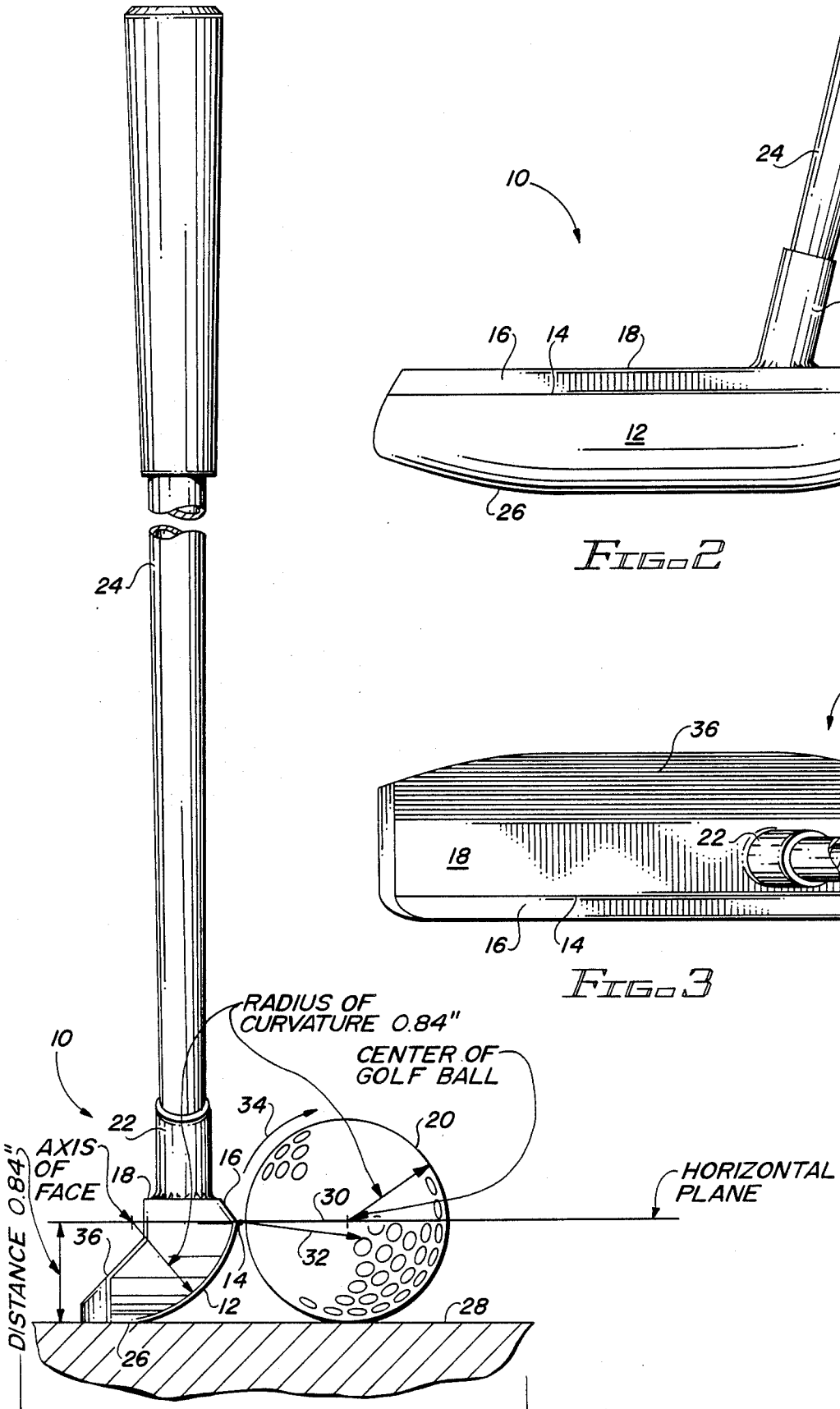
FIG. 1 is a side elevational view of the primary embodiment of a putter head constructed in accordance with the principles of the instant invention shown in playing relationship with a putter shaft, a golf ball and a putting surface.

The design of the putter head 10 depicted in the attached drawings calls for a putter surface or face 12 that is comprised of a 90 degree convex arc, a partial cylinder with a circular cross-section having a radius of about between 0.84 and 1.12 inches. Adjacent the upper edge 14 of the face 12 is a beveled edge 16 moving upwardly and rearwardly from the upper edge 14 of the curved face at approximately a 60 degree angle toward the top surface 18 of the putter head 10. The upper edge 14 of this convex face 12 of the putter is a line, the center of which is intended to meet with a point on the central horizontal plane of the golf ball 20 or slightly thereabove. The diameter of a golf ball is 1.68 inches.

The purpose of the invention is to enable a golfer to impart a forward and downward movement with overspin to the golf ball upon the putting surface, while striking the golf ball in a forward direction toward the golf hole. This instant design, along with a normal putting stroke, will immediately impart overspin to the golf ball and enable it to move in a more controlled and less restricted manner to the golf hole. It will thereby allow the golf ball to travel with immediate overspin, thereby eliminating "skid" or "sliding" or the golf ball, and the golf ball will inherently travel farther with the same stroke than the golf ball would travel if it were struck with a flat faced or lofted faced golf putter. This invention thus allows for an easier, less forceful, and more controlled putting stroke to enable the golf ball to move a greater distance. These factors lead to greater accuracy and "feel" and will enable the golfer to lower his or her scores accordingly.

The putter head 10 thus comprises a top surface or portion 18 formed with a generally upwardly directed hosel 22 for coupling the head 10 to a shaft 24 in a conventional manner. A bottom surface of portion 26 of the head 10 is formed as a sole for positioning the putter head 10 in a ball-striking orientation on a green or other putting surface 28. The ball-striking face 12 is thus located between the top and bottom portions 18 and 26. The ball-striking face is arcuate in cross-sectional shape, curved about an axis located in a horizontal plane between the top portion and the bottom portion. The radius of curvature of the ball-striking face is about between 0.84 to 1.12 inches or as close as possible thereto. Both the horizontal plane and the axis of the ball-striking face are located essentially 0.84 inches from the sole 26 and green 28 of as close as possible thereto with the curved face extending downwardly from the horizontal plane.

This orientation or component also does not allow for the golf ball 20 to be struck at an upward angle. The radius of the arc, 0.84 to 1.12 inches, when placed on the putting surface generally mirrors the lower half of the golf ball which has a 1.68 inch diameter. Regardless of whether the convex putter head 10 is flush with the green, or slightly raised as may occur during the putting stroke, no portion of the instant convex putter face can be in a position to accomplish anything other than a forward movement of the golf ball which will impart immediate overspin to the golf ball. The invention is also ideal for putting the golf ball when it is on the putting surface and against the fringe, that next level of grass higher than and adjacent to the putting surface, or when the golf ball is on the fringe and against the rough cut, that higher grass area bordering the fringe, where the use of a flat or lofted face putter can create erratic results as a result of the sharp leading edge of the sole of a flat or lofted face putter scuffing the higher grass level behind the golf ball. In such a situation the golf ball may be struck with the bottom portion of the convex putting face of the invention, and it will generate control of the golf ball and develop the overspin necessary for an accurate golf putt. In such circumstances, the fringe or rough cut may be considered the putting surface 28.

The improved head 10 has a face 12 which may be viewed as a partially circular shape which is curved about an axis. The radius of curvature of the face is essentially equal to the radius of curvature of a golf ball 20 to be struck by the face of the putter. The axis of the face is located at a distance from the bottom of the head essentially equal to the radius of curvature of the face. When the putter head 10 is in a position for putting a ball 20 with the bottom surface or sole 26 of the head 10 resting on the putting surface 28, the axis is located in a plane substantially parallel with the putting surface 28 and the plane passes through the center of the ball to be putted. The preferred putting of a ball 20 occurs with forward movement and with overspin occurring due to a downward force when the ball is struck by the curved portion of the face 12 with its axis remaining parallel with the green 28 and in a plane containing the axis and center of the ball or slightly above. The front face 12 is smooth and the rear surface 36 may take any desired configuration.

The preferred part of the ball-striking face 12 for use in striking a ball to be putted is at, or slightly below, the upper edge 14 of curved face 12. A ball being struck by this preferred part of the ball-striking face will be propelled forwardly with overspin. Arrow 30 indicates this direction of the horizontal component of motion while the arrow 32 indicates the downward component of motion which imparts the overspin indicated by arrow 34. A ball being struck by other than the preferred part of the ball-striking surfaces will, however, still be propelled forwardly with overspin. A ball is precluded from being struck by the putter head above the top edge 14 of the face 12 due to the distance between the horizontal plane and the sole being essentially the same as the radius of the ball to be struck. The preferred part of the ball-striking surface for use in striking a ball to be putted is located at the upper edge of the curved portion of the ball-striking face or slightly below. As can be seen, the face 12 is thus formed with a curved shape having its most forwardly projecting point being elevated from the lower portion 26 of the putter head 10 by a height substantially equal to the radius of a curvature of a golf ball 20 to be putted.

Extensive analysis and testing was performed with the putter head of the present invention as well as with many other known putter heads. The particular configuration of the present invention consistently resulted in superior putting results.

The putter of the present invention has a smooth, convex face for striking a ball on the forward stroke.

The foregoing has outlined rather broadly some of the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

Now that the invention has been described;

What is claimed is:

1. A golf putter comprising in combination:

a shaft;

a grip located on the upper end of the shaft;

an elongated putter head having a heel area and a toe area; the putter head being formed with a top portion including means for coupling the head to the shaft, a centrally located bottom portion constituting a sole for positioning the putter head in a ball-striking orientation on a putting green, a quarter right circular cylinder ball-striking face located therebetween and terminating at its lower end in the bottom portion and at its upper end in a horizontal edge parallel to said flat sole and adjacent to the top portion, and an upwardly and rearwardly beveled generally rectangular area between the horizontal edge and the top portion, the ball-striking face being arcuate in its cross-sectional shape with a 0.84 inches radius of curvature and curved about an axis located in a first horizontal plane above the sole, the first horizontal plane including the axis, the center of a golf ball to be struck, and the striking point of the ball-striking face, the vertical distance between the first horizontal plane and a second horizontal plane comprising the sole and the bottom of the golf ball to be struck being 0.84 inches.

* * * * *